US009756997B2

(12) United States Patent
Maoro et al.

(10) Patent No.: US 9,756,997 B2
(45) Date of Patent: Sep. 12, 2017

(54) ROBOTIC VACUUM CLEANER COMPRISING AT LEAST ONE SIDE ARM

(71) Applicant: Miele & Cie. KG, Guetersloh (DE)

(72) Inventors: Carina Maoro, Bielefeld (DE); Markus Thamm, Leopoldshoehe (DE)

(73) Assignee: MIELE & CIE. KG, Guetersloh (DE)

( * ) Notice: Subject to any disclaimer, the term of this patent is extended or adjusted under 35 U.S.C. 154(b) by 9 days.

(21) Appl. No.: 14/949,902

(22) Filed: Nov. 24, 2015

(65) Prior Publication Data

US 2016/0157691 A1 Jun. 9, 2016

(30) Foreign Application Priority Data

Dec. 8, 2014 (DE) ..... 10 2014 118 126

(51) Int. Cl.
*A47L 9/28* (2006.01)
*A47L 9/04* (2006.01)
*A47L 9/00* (2006.01)

(52) U.S. Cl.
CPC *A47L 9/04* (2013.01); *A47L 9/00* (2013.01); *A47L 9/0472* (2013.01); *A47L 9/0488* (2013.01); *A47L 2201/00* (2013.01)

(58) Field of Classification Search
CPC . A47L 9/00; A47L 9/04; A47L 9/0472; A47L 2201/00; A47L 9/0488
USPC ..... 15/319, 339
IPC ..... A47L 9/28
See application file for complete search history.

(56) References Cited

U.S. PATENT DOCUMENTS

2013/0086760 A1 4/2013 Han et al.
2013/0152332 A1* 6/2013 Jang ..... A47L 9/009 15/319
2013/0291331 A1 11/2013 Yang et al.
2015/0182087 A1 7/2015 Gerth et al.

FOREIGN PATENT DOCUMENTS

DE 102014100006 A1 7/2015
EP 2578125 A1 4/2013
EP 2891443 A1 7/2015
JP 200687508 A 4/2006
WO WO 2013051843 A1 4/2013

* cited by examiner

*Primary Examiner* — David Redding
(74) *Attorney, Agent, or Firm* — Leydig, Voit & Mayer, Ltd.

(57) ABSTRACT

A robotic vacuum cleaner includes a movable side arm. The side arm is inwardly pivotable into the inside of a housing of the robotic vacuum cleaner by a spring mechanism in the event of contact with an obstacle. The side arm is mounted on a rotary shaft so as to be pivotable and linearly displaceable along an elongate hole.

11 Claims, 6 Drawing Sheets

ROBOTIC VACUUM CLEANER COMPRISING AT LEAST ONE SIDE ARM

CROSS-REFERENCE TO PRIOR APPLICATION

Priority is claimed to German Patent Application No. DE 10 2014 118 126.3, filed on Dec. 8, 2014, the entire disclosure of which is hereby incorporated by reference herein.

FIELD

The invention relates to a robotic vacuum cleaner comprising at least one side arm, specifically a side arm which acts as a carrier of a side brush, and to a mechanism provided for moving the side arm.

BACKGROUND

Robotic vacuum cleaners comprising side arms are known. Side arms of this kind carry a side brush by means of which a region reached by the robotic vacuum cleaner in each case can be enlarged. It is known that robotic vacuum cleaners generally have a round or at least substantially round basic shape which means that corners are difficult to reach. Dust or other impurities in said corners cannot be easily reached by the robotic vacuum cleaner, meaning that the cleaning result is unsatisfactory, at least in this respect. Side arms which are laterally arranged on the robotic vacuum cleaner and extend beyond the outer periphery of the housing of the robotic vacuum cleaner, and typically rotating side brushes fixed there, serve to also reach such corners or other border regions of the floor worked by the robotic vacuum cleaner in each case.

Longer side arms or longer bristle clusters on the side brushes compared with previous solutions make it possible, in principle, to also better reach the deeper portions, for example of a corner. However, the bristle clusters of the side arms may not exceed a certain length, because there is otherwise the risk that the brush filaments which the bristle clusters comprise would enter the drive wheels of the robotic vacuum cleaner or the central bristle roller associated with the suction mouth for example. The length of the side arms is also restricted, at least by practical considerations, since, during operation, the robotic vacuum cleaner has to avoid collisions with obstacles in the form of walls, doors and furniture, or has to change its direction of travel in the event of such collisions. A collision which is typically to be avoided or a collision requiring a change of direction may occur on account of the side arms.

WO 2013/051843 A1 discloses a robotic vacuum cleaner comprising two side arms which can be moved from a position in the housing into a working position in which they are pivoted out. In this respect, WO 2013/051843 A1 describes two embodiments, specifically an embodiment in which the outward pivoting is brought about by motors, and a further embodiment in which the outward pivoting is brought about by means of a spring mechanism. Using the spring mechanism, the respective side arm is pivoted out of its position in the housing of the robotic vacuum cleaner and is held in the outwardly pivoted state by means of tensile loading. In the event of a side arm making contact with an obstacle, the side arm can be pressed back into the housing against the spring tension. WO 2013/051843 A1 does not appear to contain any considerations for the event of a collision in the variant in which the side arms are extended by means of motors.

In the case of the side arms movable by the spring mechanism in WO 2013/051843 A1, outward pivoting and inward pivoting in the event of a collision is entirely conceivable. However, the inward pivoting appears to be possible only in a collision situation during a forward movement or at least only in the event of contact of an edge of the side arm at the front in the outward pivoting direction with an obstacle. If, on the other hand, the side arm strikes an obstacle with the edge thereof at the rear in the outward pivoting direction, the force resulting from the collision with the obstacle acts in the outward pivoting direction and thus directly prevents inward pivoting of the side arm and elimination of the collision situation. However, this type of contact of the edge of a side arm at the rear in the outward pivoting direction with an obstacle is possible at any time during a rotational movement of the robotic vacuum cleaner for example. In such a case, the robotic vacuum cleaner proposed in WO 2013/051843 A1 appears to be unable to continue a started rotational movement. The motor-driven side arms of WO 2013/051843 A1 appear to be problematic in the event of a collision with an obstacle, regardless of a respective rotational direction.

SUMMARY

In an embodiment, the present invention provides a robotic vacuum cleaner including a movable side arm. The side arm is inwardly pivotable into the inside of a housing of the robotic vacuum cleaner by a spring mechanism in the event of contact with an obstacle. The side arm is mounted on a rotary shaft so as to be pivotable and linearly displaceable along an elongate hole.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
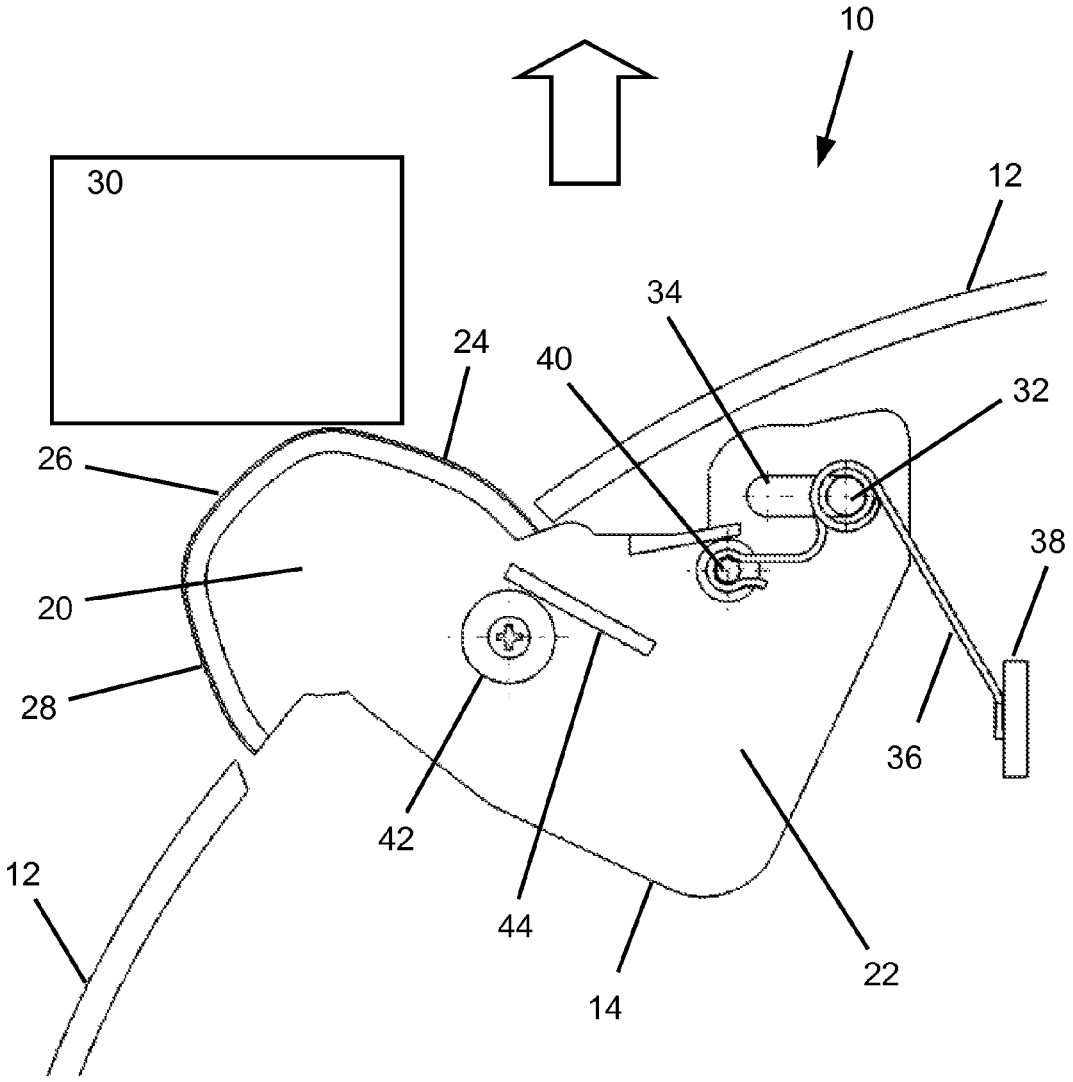
FIG. 1 is a section through a part of a housing of a robotic vacuum cleaner and a side arm which is movable in the housing.

In an embodiment, the present invention provides a robotic vacuum cleaner comprising at least one movable side arm and a mechanism making possible the mobility of the side arm, which side arm and/or mechanism permit movement of the affected side arm into a position inside the housing of the robotic vacuum cleaner in the event of a collision, i.e. in the event of contact of the side arm with an obstacle, in order to thus eliminate a collision situation.

In an embodiment the present invention provides a robotic vacuum cleaner comprising a side arm which is movable and acts as a carrier for a side brush. It is provided for the side arm to be pivotable about a rotary shaft by means of a spring mechanism, for the side arm to be inwardly pivotable into the inside of a housing of the robotic vacuum cleaner in the event of contact with an obstacle, and for the side arm to be mounted on the rotary shaft so as to be both pivotable and linearly displaceable by means of an elongate hole.

The pivotability of the side arm makes it possible for the side arm to be inwardly pivoted into the inside of the housing of the robotic vacuum cleaner if the side arm touches an obstacle in a first movement direction of the robotic vacuum cleaner, for example during a forward movement of the robotic vacuum cleaner or during a rotational movement in a first rotational direction. Since the side arm is mounted on the elongate hole so as to be linearly displaceable, the elongate hole acts a linear bearing for the side arm. The side arm can perform an avoidance and retreat into the inside of the housing of the robotic vacuum cleaner in the direction of the elongate hole, even in the event of touching an obstacle during a rotational movement counter to the first rotational direction, i.e. a rotational movement in a second rotational direction. Depending on the direction of the strike against the obstacle, in addition to the linear movement along the elongate hole, the side arm is also pivoted into the inside of the housing, still within the scope of the pivotability thereof.

In one embodiment of the robotic vacuum cleaner, the side arm is distinguished by an L-shaped, or at least substantially L-shaped, basic shape having a first and a second leg, wherein the elongate hole is located at the free end of the leg positioned in the housing of the robotic vacuum cleaner. In order to improve the readability of the following description, the part of the side arm which protrudes beyond the border of the housing in the outwardly pivoted state and acts as a carrier of a side brush is referred to in the following as a brush carrier part or brush carrier portion. The part of the side arm from which the brush carrier portion extends is referred to, for the purpose of differentiation, as the base part or base portion. The base portion comprises the elongate hole and can be interpreted as the first or long leg of the L-shaped basic shape. The brush carrier portion is then, correspondingly, the second or short leg. Due to this bent basic shape, the side arm only requires a small amount of space in the housing of the robotic vacuum cleaner and, due to the pivot axis being close to the outer edge of the housing, a small amount of pivoting of the base portion is sufficient in order to completely pull the brush carrier portion into the inside of the housing. In this case, the opening in the housing through which the base portion protrudes from the housing in the outwardly pivoted state can be relatively small, because the side arm is pivoted substantially in the inside of the housing.

In one embodiment of the robotic vacuum cleaner, the elongate hole in the side arm is oriented in such a way that a longitudinal axis of the elongate hole points towards the brush carrier portion, i.e. towards the part of the side arm which protrudes beyond a border of the housing when the side arm is pivoted out. Since the elongate hole is oriented towards the brush carrier portion, in the event of the brush carrier portion thereof striking against an obstacle, the entire side arm can be displaced along the elongate hole and the collision situation can thus be eliminated. A direction of action of a force is found based on the respective direction of travel of the robotic vacuum cleaner and the point of the brush carrier portion which strikes against the obstacle, referred to in the following as the strike point. According both to the respective direction of action of the force and to a line through the strike point and the pivot axis of the side arm, in the event of touching the obstacle, in addition to the translational movement along the elongate hole, the side arm also pivots into the inside of the housing, with the result that the brush carrier portion is retracted and the collision situation is likewise eliminated.

In a special variant of the above-described embodiment, when the side arm is pivoted out the elongate hole pointing towards the brush carrier portion is oriented transversely to the direction of travel occurring during a forward movement of the robotic vacuum cleaner. When the brush carrier portion strikes an obstacle during a forward movement of the robotic vacuum cleaner, there is thus usually no movement of the side arm along the elongate hole and a purely pivoting movement results as the movement of the side arm due to striking the obstacle, by means of which movement the brush carrier portion is retracted into the inside of the housing.

In a particular embodiment of the robotic vacuum cleaner, the spring mechanism comprises a leg spring, by means of the spring force of which the side arm can be outwardly pivoted into the working position and against the spring force of which the side arm can be inwardly pivoted into the inside of the housing. In an advantageous manner, the leg spring requires only a small amount of space inside the housing of the robotic vacuum cleaner and, if the leg spring is favourably arranged, the space requirement thereof is limited to just the pivoting region or at least substantially to just the pivoting region of the side arm.

This type of favourable arrangement of the leg spring consists, for example, in that a first leg of the leg spring extends as far as a support on the housing of the robotic vacuum cleaner, in that a second leg of the leg spring engages on the side arm, and in that at least one coil of the leg spring, from which the first and the second leg extend, is fixed to the rotary shaft. The coil of the leg spring and the second leg are thus located below or above the side arm and in any case in the pivoting region of the side arm. The first leg extends beyond the side arm in the pivoting direction and is thus likewise located in the pivoting region. When the support extends out of the housing below or above the side arm, it is possible to limit the space requirement of the leg spring even further.

In a particular embodiment of the robotic vacuum cleaner comprising at least one pivotable side arm, the mechanism which permits the mobility of the side arm comprises, in addition to the spring mechanism, a guide mechanism which becomes active in the case of a displacement of the side arm along the elongate hole. The guide mechanism deflects the side arm during a linear movement along the elongate hole and thus adds a component, in a direction different from the orientation of the elongate hole, to the movement of the side arm along the elongate hole. The additional movement component resulting on account of the guide mechanism leads to pivoting of the side arm about the pivot axis and thus to the brush carrier portion being retracted into the inside of the housing. The guide mechanism thus causes positively driven pivoting of the side arm even if no pivoting of the side arm results purely from the strike point of the obstacle on the brush carrier portion.

In a particular embodiment of the robotic vacuum cleaner comprising a guide mechanism of this kind, said guide mechanism comprises a guide roller and a guide rib. One of the parts of the guide mechanism, i.e. the guide rib for example, is located on the side arm. The other part, i.e. the guide roller for example, is located on the housing of the robotic vacuum cleaner or is attached in a stationary manner at least in relation to the movable side arm. The guide mechanism is distinguished in that a longitudinal axis of the guide rib and the longitudinal axis of the elongate hole enclose an acute angle, and/or in that a longitudinal axis of the guide rib and a front edge of the brush carrier portion are oriented so as to be parallel or at least substantially parallel. The brush carrier portion comprises three edges which are located outside the housing of the robotic vacuum cleaner when a side arm is pivoted out, specifically a front edge, a side edge and a rear edge. The side edge extends in parallel or substantially in parallel with the border of the housing. The front edge is the edge of the brush carrier portion which is joined to the side edge and points in the direction of travel during forward travel of the robotic vacuum cleaner. The rear edge is the remaining third edge. Since the guide rib is oriented so as to be in parallel or substantially in parallel with the front edge of the brush carrier portion, or since the longitudinal axis of the guide rib and the longitudinal axis of the elongate hole enclose an acute angle, an opening of which the width is only slightly greater than the width of the brush carrier portion is sufficient as the opening in the housing. During inward pivoting of the side arm and during rolling of the guide roller on the guide rib, the direction of the retraction of the brush carrier portion is determined in a decisive manner by the orientation of the guide rib and, on account of the orientation of the guide rib, is parallel or substantially parallel to the front edge of the brush carrier portion. As a result, a spacing between the front edge of the brush carrier portion and the front border of the housing opening remains the same or substantially the same during the retraction. During this retraction of the brush carrier portion, the side arm also moves along the elongate hole. A linear or substantially linear movement of the brush carrier portion is achieved by means of the guide mechanism and by means of the linear mobility along the elongate hole, with the result that said brush carrier portion can be retracted through a correspondingly narrow housing opening and, in any case, a housing opening having an opening size which permits a pivoting movement on a greater scale is not required.

Figure 2:
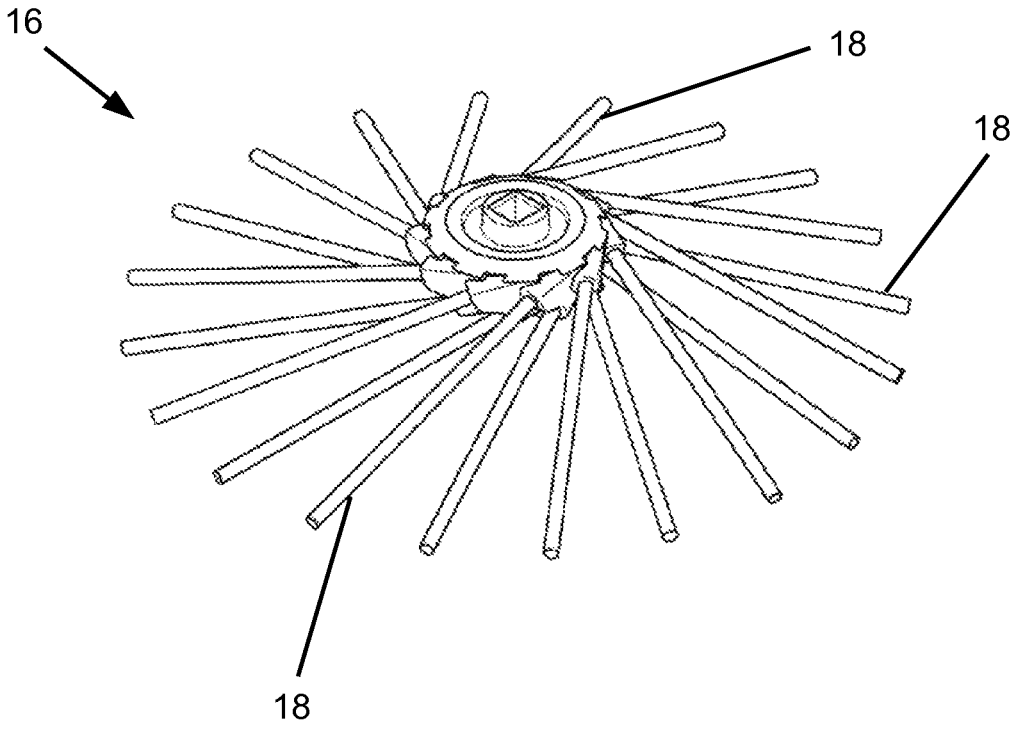
FIG. 2 shows a side brush such as is possible for attaching to the side arm according to FIG. 1.

FIG. 1 is a schematic section through a robotic vacuum cleaner 10, from which parts of the border region of a housing 12 can be identified. A plane which is parallel to the floor to be worked has been selected as the sectional plane. A movable side arm 14 is located in the shown portion of the housing 12. The side arm 14 and a corresponding side arm on the other side of the robotic vacuum cleaner 10 are each provided as a carrier of a side brush 16. A possible embodiment of a side brush 16 of this kind comprising a bristle cluster 18 arranged on a rotatable brush core is shown in the drawing in FIG. 2.

In order to improve the readability of the description, a portion of the side arm 14 which is intended for attaching the side brush 16 is referred to as the brush carrier portion 20. The brush carrier portion 20 is located outside the housing 12 when the side arm 14 is pivoted out, as shown in FIG. 1. The portion of the side arm 14 which is located in the housing 12 in the outwardly pivoted state is referred to as the base portion 22. The base portion 22 can be interpreted as the long leg of the L-shaped side arm 14. The brush carrier portion 20 forms the remaining short leg. Said portion comprises substantially three edges 24, 26, 28, specifically a front edge 24, a side edge 26 and a rear edge 28. The side edge 26 extends in parallel or substantially in parallel with the border of the housing 12. The front edge 24 is the edge of the brush carrier portion 20 which is joined to the side edge 26 and points in the direction of travel during forward travel of the robotic vacuum cleaner 10. The rear edge 28 is the remaining third edge.

The mobility of the side arm 14 permits contact with an obstacle 30 located in the movement region of the robotic vacuum cleaner 10 without the risk of the robotic vacuum cleaner 10 becoming stuck on the obstacle 30 and subsequently no further movement of the robotic vacuum cleaner 10 being possible.

The side arm 14 is mounted so as to be both pivotable about a rotary shaft 32 and linearly displaceable along the rotary shaft 32. An elongate hole 34 in the side arm 14 acts as a means for the linear displaceability of the side arm 14 relative to the rotary shaft 32. In the embodiment shown, the elongate hole 34 is located at the free end of the leg of the L-shaped side arm 14 referred to as the base portion 22. For example, a peg or the like which is rigidly connected to the housing 12, in particular integrally connected to the housing 12, acts as the rotary shaft 32.

Figure 3:
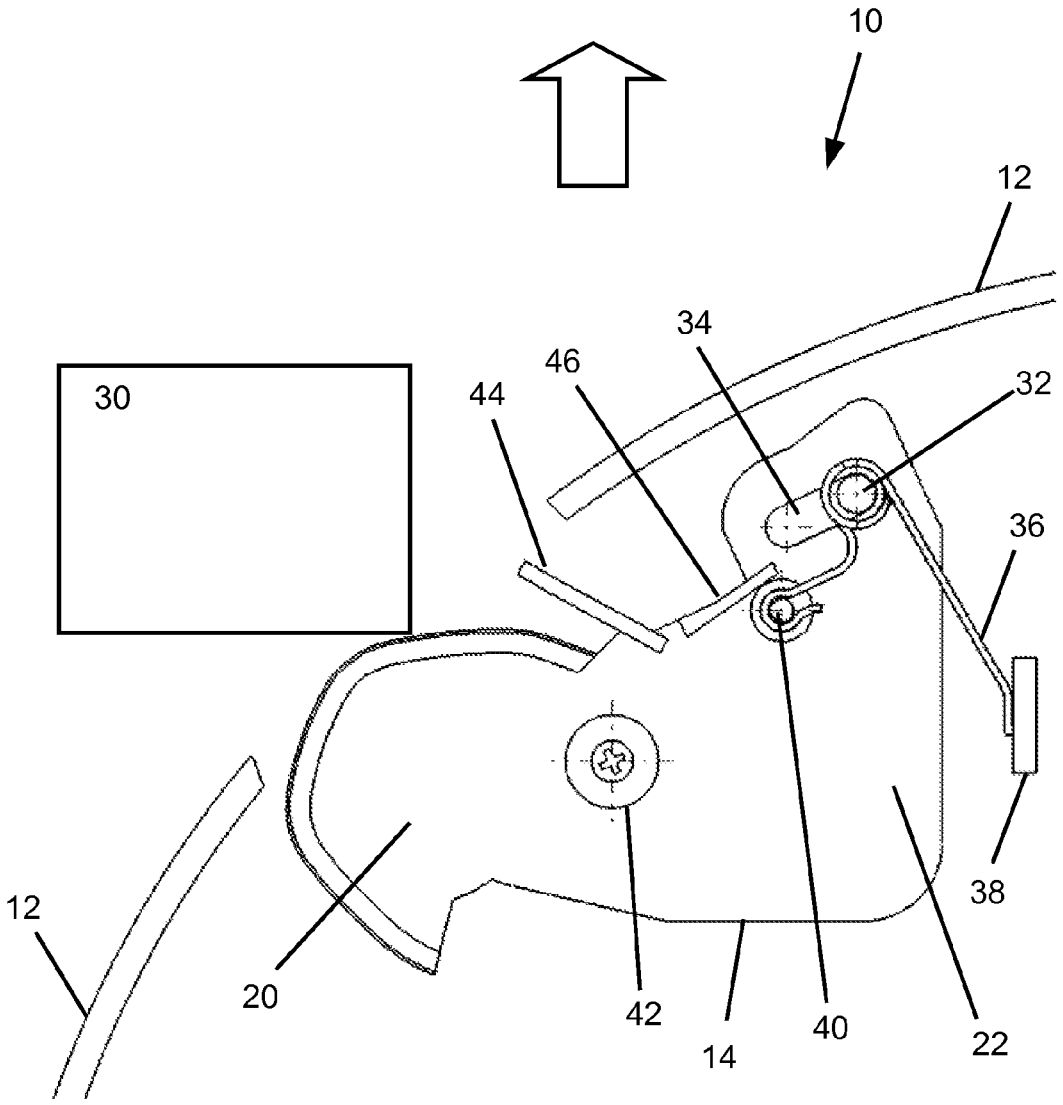
FIG. 3 shows a side arm which is inwardly pivoted into the housing of the robotic vacuum cleaner after touching an obstacle.

FIG. 1 and FIG. 3 are snapshots during a forward movement of the robotic vacuum cleaner 10 (indicated by the block arrow), and during an event of contact of the side arm 14, specifically the brush carrier portion 22, with an obstacle 30, for example a leg of a piece of furniture, occurring during the forward movement. The position of the side arm 14 shown in FIG. 1 is referred to as the outwardly pivoted position or the working position. The position shown in FIG. 3 is referred to as the inwardly pivoted or retracted position. As can be seen from the difference between the drawings in FIG. 1 and FIG. 3, in the event of contact with an obstacle 30, the brush carrier portion 22 retreats into the inside of the housing 12 of the robotic vacuum cleaner 10 on account of the rotatability of the side arm 14 at the rotary shaft 32. In the process, for example a sensor or the like is activated and generates a contact signal indicating the contact with the obstacle 30. In the embodiment shown in the figures, a sensor is located below the side arm 14 and is therefore not visible in the sectional plane selected. The contact signal is forwarded to a control unit of the robotic vacuum cleaner 10. In the event of a contact signal arriving during a forward movement and a corresponding activation of the drive wheels of the robotic vacuum cleaner 10, the control unit triggers a conventional avoidance strategy of the robotic vacuum cleaner 10 on account of the contact signal, for example such that the robotic vacuum cleaner 10 returns along a predetermined or predeterminable distance counter to the previous direction of travel, then performs a rotation about a predetermined or predeterminable angle, and subsequently continues again in the forward direction.

As soon as the side arm 14 is free of the obstacle 30 during a corresponding movement of the robotic vacuum cleaner 10, said arm pivots out again. A leg spring 36 is provided for this purpose, which spring normally holds the side arm 14 in the outwardly pivoted position (as shown in FIG. 1), such that the side brush 16 is also pivoted out of the housing 12 of the robotic vacuum cleaner 10. The leg spring 36 engages on the housing 12 of the robotic vacuum cleaner 10, here on a support 38 extending from the housing 12, at one end, and on the side arm 14, here a pin 40 on the side arm 14 or a caster on a pin 40 of this kind, at the other end. The leg spring 36 is fixed to a shaft between the support 38 and the pin 40, in this case the peg acting as the rotary shaft 32. From there, a first leg of the leg spring 36 extends as far as the support 38 and a second leg extends as far as the pin 40. When the side arm 14 is pivoted in (FIG. 3), greater tension of the leg spring 36 results, and the leg spring 36 is at least in part relaxed when the side arm 14 is pivoted out (FIG. 1).

Figure 4:
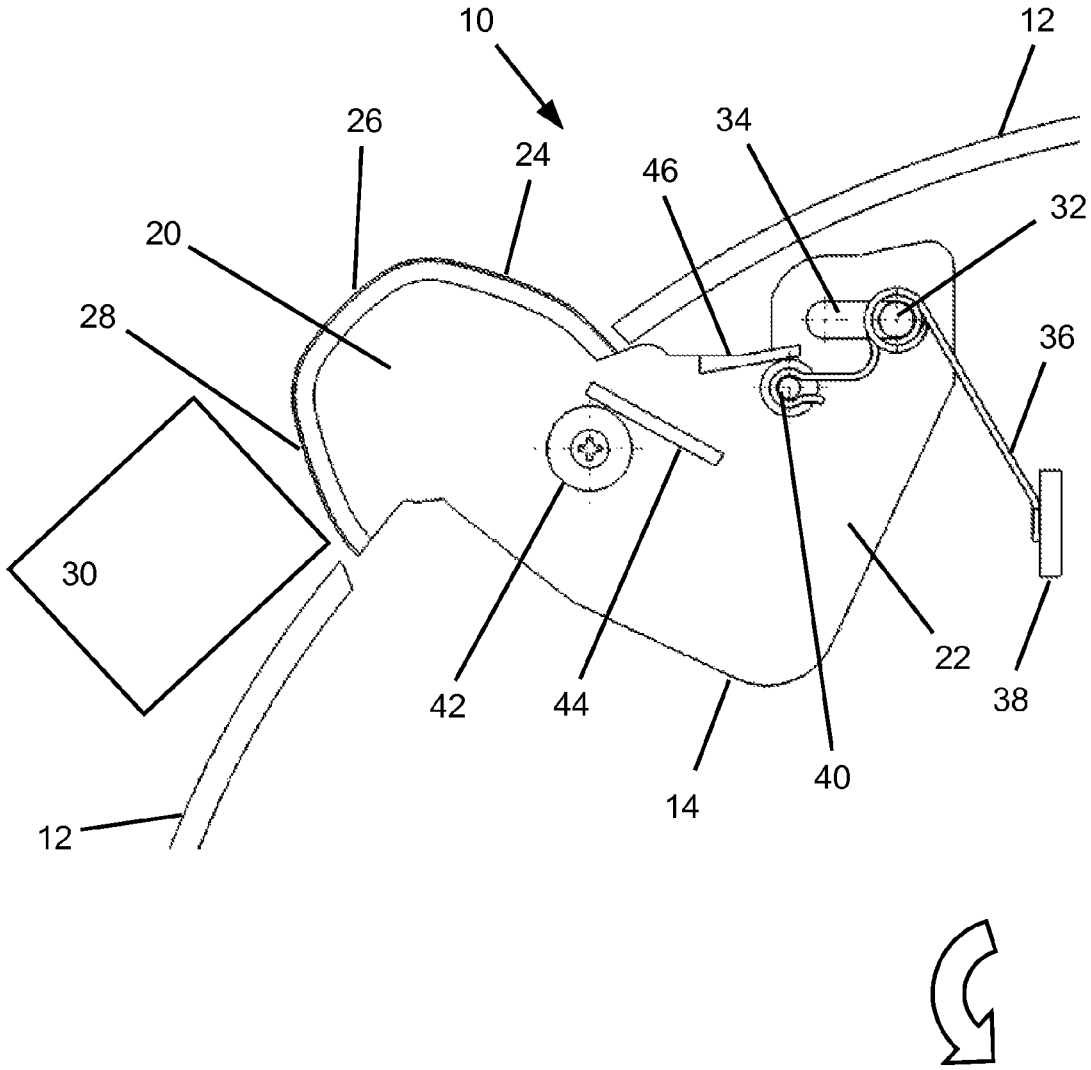
FIGS. 4-6 are snapshots of the side arm according to FIG. 1 and FIG. 3 when touching an obstacle in another movement direction compared with FIG. 1 and FIG. 3.
Figure 5:
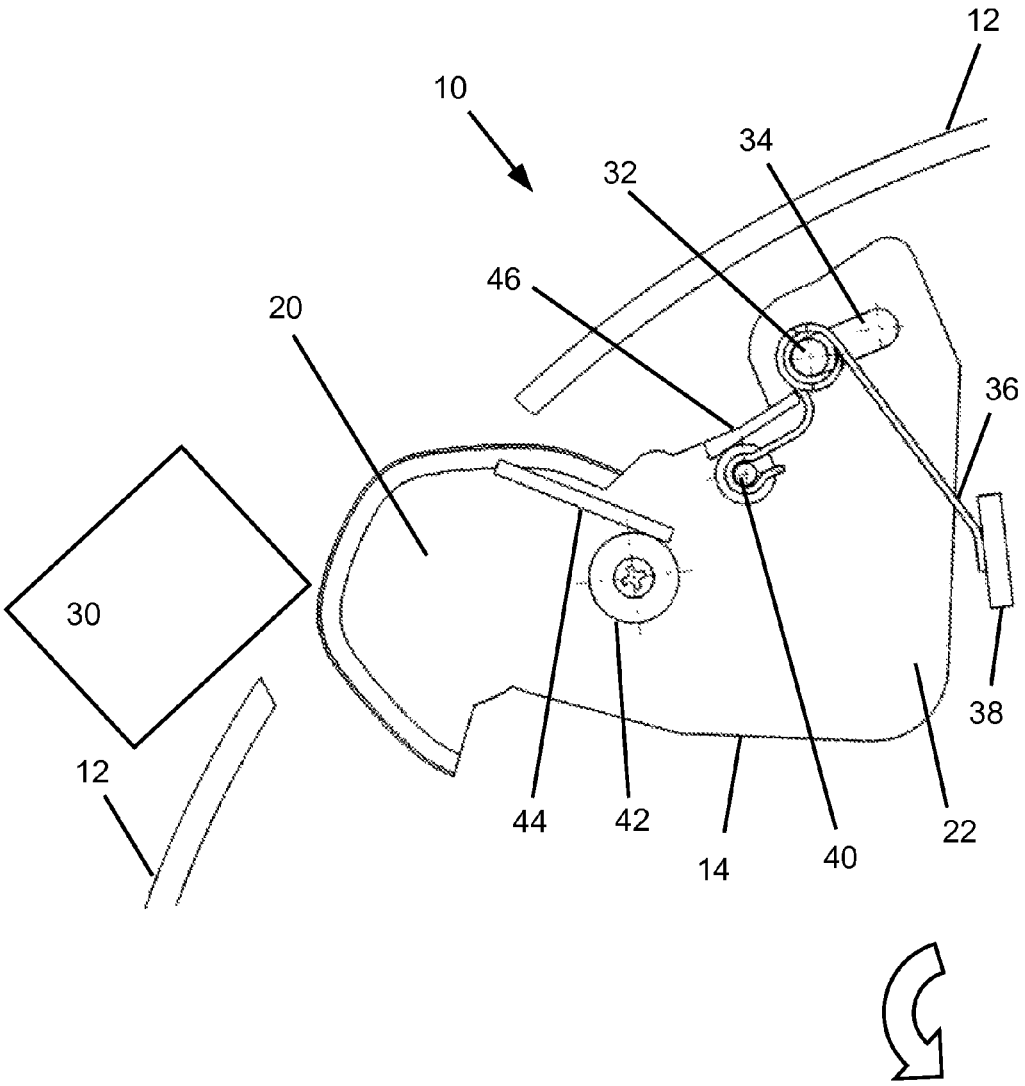
Figure 6:
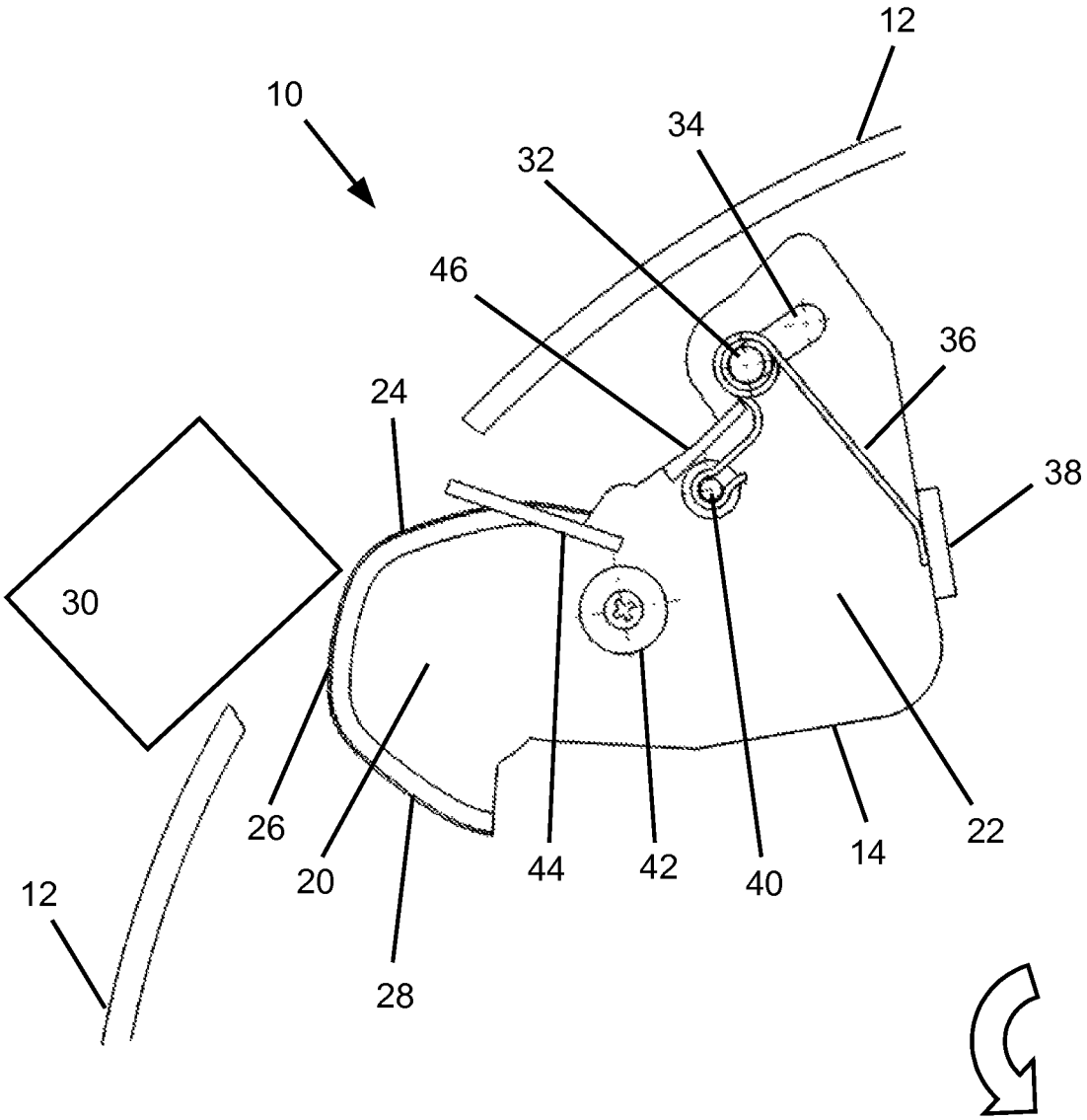

The side arm 14 can also avoid an obstacle 30 with which the brush carrier portion 20 thereof comes into contact on account of a rotation of the robotic vacuum cleaner 10, as is shown in FIGS. 4 to 6. Here, the rotational direction of the robotic vacuum cleaner 10 is indicated in each case by the block arrow in the bottom right-hand corner.

In the case of an anticlockwise rotational direction, the left-hand side arm 14 of the robotic vacuum cleaner 10 shown comes into contact with the obstacle 30 at the rear edge 28 of the brush carrier portion 20. In the case of a clockwise rotational direction the left-hand side arm 14 avoids the obstacle 30 in the same manner as is the case in the event of contact with an obstacle during forward travel, i.e. the side arm 14 pivots about the rotary shaft 32 thereof into the inside of the housing 12. This and the following description apply correspondingly to the right-hand side arm which is not shown.

In the event of contact of the rear edge 28 of the brush carrier portion 20 with the obstacle 30, the pivotability of the side arm 14 about the rotary shaft 32 is not always sufficient, alone, for inwardly pivoting said arm, and the side arm 14 may jam. Inward pivoting of the side arm 14 into the inside of the housing 12 then does not occur immediately. In addition, a side arm 14 which is jammed in this way is still in its outwardly pivoted working position, meaning that a sensor or the like provided for identifying a collision is not activated either. In the absence of a contact signal obtainable from this, a conventional avoidance strategy of the robotic vacuum cleaner 10 is not instigated either, and consequently the robotic vacuum cleaner 10 would have manoeuvred into a position requiring intervention from the user.

In order to prevent a situation of this kind, the side arm 14 is mounted on the rotary shaft 32 so as to be not only pivotable but also linearly displaceable by means of the elongate hole 34. In the event of contact with an obstacle 30 (FIG. 4), the elongate hole 34 acts as a linear guide for the side arm 14 and the side arm 14 is displaced along the elongate hole 34. This alone can prevent or trigger jamming of the side arm 14 which is otherwise possible. Jamming is reliably avoided by means of a guide mechanism 42, 44 which acts as a further linear guide. In this case, the further linear guide acts in a direction different from the direction of the elongate hole 34 acting as the first linear guide. In the embodiment shown, the guide mechanism 42, 44 acts as a stop during outward pivoting of the side arm 14. In the embodiment shown, a guide roller 42 and a guide rib 44 act both as the guide mechanism 42, 44 and accordingly also the further linear guide, and as the stop.

The guide roller 42 permits particularly low-friction rolling on the guide rib 44. In principle, however, a pin or another adjuster are also possible instead of a guide roller 42, by means of which a surface or a border surface portion is movable along the guide rib 44. In the embodiment shown, the guide rib 44 is connected to the housing 12, in particular integrally connected to the housing 12. All that matters, however, is that the guide rib 44 is fixed, relative to the side arm 14, in its position and orientation. The guide rib 44 can therefore also be attached in a different manner. In the embodiment shown, the guide roller 42 is attached to the side arm 14, for example by the guide roller 42 being located on a pin, acting as the rotary shaft of the guide roller 42, which pin is integrally connected to the side arm 14 and rises up perpendicularly on the surface of the side arm 14. The elements of the guide mechanism 42, 44 can, however, be arranged in precisely the opposite manner, in such a way that the guide rib 44 is located on the side arm 14 and the guide roller 42 is located on the housing 12.

Since the guide mechanism 42, 44 acts as a stop in the event of outward pivoting of the side arm 14, the two elements of the guide mechanism 42, 44 are usually in contact with each other. In the embodiment shown, the guide roller 42 lies on the guide rib 44 when the side arm 14 is pivoted out. This situation is also shown in the drawing in FIG. 4. In the rotational movement of the robotic vacuum cleaner 10 assumed here in order to explain the mechanism of the side arm 14 (anticlockwise; see the block arrow), the rear edge 28 of the brush carrier portion 20 strikes the obstacle 30. On account of the engaged guide mechanism 42, 44, the guide roller 42 rolls along the guide rib 44 when the rotational movement of the robotic vacuum cleaner 10 progresses further. In the process, the brush carrier portion 20 of the side arm 14 is retracted by the entire side arm 14 being pivoted about the rotary shaft 32 thereof, in a manner positively driven by the guide mechanism 42, 44. The mounting of the side arm 14 on the elongate hole 34 permits the mobility necessary therefor in the region of the rotary shaft 32. The drawing in FIG. 5 shows a situation in which the brush carrier portion 20 has already been substantially retracted into the inside of the housing 12 by pivoting the side arm 14. The guide roller 42 is located close to the end of the guide rib 44 and the side arm 14 has also been displaced along the elongate hole 34 during the positively driven motion by means of the guide mechanism 42, 44, with the result that the peg acting as the rotary shaft 32 is at the opposite end of the elongate hole 34 in the situation shown in FIG. 5 compared with the configuration in the event of an outwardly pivoted side arm 14 (FIG. 4).

The drawing in FIG. 6 shows a side arm 14 which is fully pivoted in. There is no longer a situation of collision with the obstacle 30; in any case, the brush carrier portion 20 of the side arm 14 can slide along the obstacle 30 by means of the edges 24, 26, 28 (sliding edges) of said side arm which are produced from a low-friction plastics material for example. In the process, the side arm 14 may also be further pivoted about the rotary shaft 32 thereof. In this case, the guide mechanism 42, 44 may possibly come out of engagement. In this case, the side arm 14 can be pivoted until it makes contact with the support 38 which now acts as the stop.

In the event of the pivoting of the side arm 14 shown in the drawings in FIG. 4, FIG. 5 and FIG. 6, the pivoting occurs against the spring tension of the leg spring 36 and the spring tension increases as the pivoting of the side arm 14 increases. As soon as the collision situation with the obstacle 30 no longer exists, the side arm 14 is pivoted out again, back into the working position, by means of the leg spring 36 (FIG. 1/FIG. 4). In the embodiment shown, the side arm 14 also comprises an optional further guide rib 46 in the vicinity of the elongate hole 34, in addition to the guide rib 44 and the guide mechanism 42, 44. The further guide rib 46 serves to influence the spring force of the leg spring 36. For this purpose, the further guide rib 46 is integrally formed on the side arm 14 in an orientation which encloses an acute angle together with the longitudinal axis of the elongate hole 34, and the elongate hole 34 and the further guide rib 46 are thus not parallel. When the side arm 14 is displaced along the elongate hole 34, the pin 40 or a caster on the pin 40 roll along a side face of the further guide rib 46, and the leg spring 36 is additionally tensioned, with the result that an increased spring force results for outward pivoting of the side arm 14 as soon as said arm is free again of the obstacle 30.

In the event of a rotational movement of the robotic vacuum cleaner 10 and a side edge 26 or rear edge 28 of a side arm 14 subsequently striking an obstacle 30, it is not necessary for the robotic vacuum cleaner 10 to stop or change direction of travel because the collision situation can be eliminated by inwardly pivoting the respectively affected side arm 14 as described. When a sensor in the interior of the housing 12 of the robotic vacuum cleaner 10 is activated and a contact signal is triggered during inward pivoting of the side arm 14, said signal is not evaluated by the control unit on account of a link to the direction of travel, i.e. the respective activation of the drive wheels. The same sensor, and a contact signal generated thereby, are accordingly used differently depending on the situation.

Finally, the description provided here can be summarised as follows: A robotic vacuum cleaner 10 is disclosed comprising at least one pivotable side arm 14, wherein the side arm 14 is mounted so as to be not only pivotable but also linearly displaceable in order to inwardly pivot into the inside of a housing 12 of the robotic vacuum cleaner 10 in the event of a collision with an obstacle 30, and wherein an elongate hole 34 is provided in the side arm 14 for the pivotable and linearly displaceable mounting.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

10 Robotic vacuum cleaner
12 Housing (of the robotic vacuum cleaner)
14 Side arm
16 Side brush
18 Bristle cluster (of the side brush)
20 Brush carrier portion (of the side arm)
22 Base portion (of the side arm)
24 Front edge (of the side arm)
26 Side edge (of the side arm)
28 Rear edge (of the side arm)
30 Obstacle
32 Rotary shaft (of the side arm)
34 Elongate hole (in the side arm)
36 Spring mechanism/Leg spring
38 Support (of the leg spring on the housing)
40 Pin (on the side arm)
42 Guide mechanism/Guide roller
44 Guide mechanism/Guide rib
46 Further guide rib

What is claimed is:

1. A robotic vacuum cleaner comprising:

a movable side arm, the side arm being inwardly pivotable into the inside of a housing of the robotic vacuum cleaner by a spring mechanism in the event of contact with an obstacle, wherein the side arm is mounted on a rotary shaft so as to be pivotable and linearly displaceable along an elongate hole, and wherein the elongate hole in the side arm is oriented so that a longitudinal axis of the elongate hole points in the direction of a part of the side arm that protrudes beyond a border of the housing when the side arm is pivoted out.

2. The robotic vacuum cleaner of claim 1, wherein the side arm has an L-shaped basic shape having a first and a second leg, wherein the elongate hole is located at a free end of the first leg of the L-shaped basic shape, and wherein a free end of the second leg acts as a carrier for a side brush.

3. The robotic vacuum cleaner of claim 1, wherein the elongate hole in the side arm is oriented so that a longitudinal axis of the elongate hole is oriented transversely to a direction of travel resulting during a forward movement of the robotic vacuum cleaner when the side arm is pivoted out.

4. The robotic vacuum cleaner of claim 1, wherein the spring mechanism comprises a leg spring, a spring force of which is configured to outwardly pivot the side arm, and against the spring force of which the side arm can be inwardly pivoted.

5. The robotic vacuum cleaner of claim 4, wherein a first leg of the leg spring extends as far as a support on the housing of the robotic vacuum cleaner, a second leg of the leg spring engages on the side arm, and at least one coil of the leg spring, from which the first and the second leg extend, is fixed to the rotary shaft.

6. The robotic vacuum cleaner of claim 1, further comprising a guide mechanism which is configured to act in the event of a displacement of the side arm along the elongate hole, wherein the guide mechanism is configured to deflect the side arm from a linear movement along the elongate hole and configured to add a component in a direction different from the orientation of the elongate hole to the movement of the side arm along the elongate hole.

7. The robotic vacuum cleaner of claim 6, wherein the guide mechanism is configured to act as a stop during outward pivoting of the side arm.

8. The robotic vacuum cleaner of claim 6, wherein the guide mechanism comprises a guide roller and a guide rib, and wherein one of the guide roller and the guide rib is located on the side arm and the other is located on the housing of the robotic vacuum cleaner.

9. The robotic vacuum cleaner of claim 8, wherein the guide roller is attached to the side arm and the guide rib is attached to the housing of the robotic vacuum cleaner.

10. A robotic vacuum cleaner comprising:

a movable side arm, the side arm being inwardly pivotable into the inside of a housing of the robotic vacuum cleaner by a spring mechanism in the event of contact with an obstacle, wherein the side arm is mounted on a rotary shaft so as to be pivotable and linearly displaceable along an elongate hole, and wherein the side arm has an L-shaped basic shape having a first and a second leg, wherein the elongate hole is located at a free end of the first leg of the L-shaped basic shape, and wherein a free end of the second leg acts as a carrier for a side brush.

11. A robotic vacuum cleaner comprising:

a movable side arm, the side arm being inwardly pivotable into the inside of a housing of the robotic vacuum cleaner by a spring mechanism in the event of contact with an obstacle, wherein the side arm is mounted on a rotary shaft so as to be pivotable and linearly displaceable along an elongate hole, and wherein the elongate hole in the side arm is oriented so that a longitudinal axis of the elongate hole is oriented transversely to a direction of travel resulting during a forward movement of the robotic vacuum cleaner when the side arm is pivoted out.

* * * * *